US012000154B2

(12) United States Patent
Pressnell et al.

(10) Patent No.: US 12,000,154 B2
(45) Date of Patent: Jun. 4, 2024

(54) INTERLOCKING TILE

(71) Applicant: CH3 Solutions, LLC, Dalton, GA (US)

(72) Inventors: Joshua Pressnell, Dalton, GA (US); Ron Bennett, Dalton, GA (US); William Lambert, Palmetto, FL (US)

(73) Assignee: CH3 Solutions, LLC, Dalton, GA (US)

( * ) Notice: Subject to any disclaimer, the term of this patent is extended or adjusted under 35 U.S.C. 154(b) by 0 days.

(21) Appl. No.: 17/646,034

(22) Filed: Dec. 27, 2021

(65) Prior Publication Data

US 2023/0203822 A1 Jun. 29, 2023

(51) Int. Cl.
*E04F 11/16* (2006.01)
*E04F 15/02* (2006.01)

(52) U.S. Cl.
CPC ..... *E04F 15/02* (2013.01); *E04F 2201/095* (2013.01)

(58) Field of Classification Search
CPC ..... E04F 15/02; E04F 2201/095
See application file for complete search history.

(56) References Cited

U.S. PATENT DOCUMENTS 3,735,988 A 5/1973 Palmer et al.
4,468,910 A * 9/1984 Morrison ..... E01C 11/225 52/177
4,902,540 A 2/1990 Martino
5,076,534 A * 12/1991 Adam ..... F16M 5/00 52/591.1
5,323,575 A 6/1994 Yeh
5,628,160 A * 5/1997 Kung ..... E04F 15/105 52/177
5,904,021 A * 5/1999 Fisher ..... E01C 13/045 52/177
6,751,912 B2 * 6/2004 Stegner ..... E01C 5/20 52/177
6,802,159 B1 10/2004 Kotler
7,114,298 B2 10/2006 Kotler
7,516,587 B2 4/2009 Barlow
7,698,859 B2 4/2010 Marti
7,930,865 B2 4/2011 Barlow
7,955,025 B2 6/2011 Murphy et al.
8,128,311 B2 * 3/2012 Son ..... E01C 13/083 403/326
8,141,314 B2 3/2012 Rosan
(Continued)

FOREIGN PATENT DOCUMENTS

CN 110644722 A 1/2020

OTHER PUBLICATIONS

European Search Report, dated May 23, 2023, 8 pages, issued in EP Application No. 22216526.8.

*Primary Examiner* — Basil S Katcheves
(74) *Attorney, Agent, or Firm* — Avek IP, LLC

(57) ABSTRACT

An interlocking tile includes a top surface, a bottom surface, and marginal faces disposed along a perimeter of the top surface. The tile also includes at least one male coupler disposed on a first marginal face and at least one female coupler extending from the bottom surface and disposed on a second marginal face. The at least one female coupler includes an arm, the arm comprising a first notch for engaging with a corresponding male coupler of an adjacent tile at a first position, and a second notch for engaging with the corresponding male coupler of the adjacent tile at a second position.

20 Claims, 11 Drawing Sheets

(56) References Cited

U.S. PATENT DOCUMENTS

| | | | | |
|---|---|---|---|---|
| 8,266,857 | B2 | 9/2012 | David | |
| 9,267,244 | B2 | 2/2016 | Bennett et al. | |
| 10,941,577 | B1 | 3/2021 | Bennett et al. | |
| 2004/0058096 | A1 | 3/2004 | Prevost | |
| 2006/0260264 | A1 | 11/2006 | Reynolds | |
| 2006/0283118 | A1 | 12/2006 | Moller | |
| 2006/0283125 | A1 | 12/2006 | Moller | |
| 2007/0059481 | A1* | 3/2007 | Lin | E04F 15/02 428/44 |
| 2007/0289244 | A1 | 12/2007 | Haney et al. | |
| 2008/0072514 | A1 | 3/2008 | Barlow | |
| 2008/0092473 | A1 | 4/2008 | Heyns | |
| 2009/0178367 | A1 | 7/2009 | Barlow | |
| 2010/0313510 | A1* | 12/2010 | Tang | E04F 15/182 52/578 |
| 2012/0110804 | A1 | 5/2012 | Hussmann | |
| 2013/0291457 | A1* | 11/2013 | Tillery | E04F 15/107 52/177 |
| 2013/0291474 | A1* | 11/2013 | Tillery | A47G 27/0218 29/428 |
| 2015/0075092 | A1* | 3/2015 | Moller, Jr. | E04F 15/02038 52/177 |
| 2016/0129299 | A1* | 5/2016 | Newman | A63B 21/4037 482/142 |
| 2019/0186155 | A1* | 6/2019 | Huss | E04F 15/105 |

* cited by examiner

INTERLOCKING TILE

FIELD OF THE DISCLOSURE

The disclosure relates generally to the field of floor tiles. More specifically, the disclosure relates to interlocking floor tiles and systems and methods incorporating interlocking floor tiles.

BACKGROUND

Interlocking floor tiles are known in the art. Such tiles employ various interlocking mechanisms. Often, the interlocking mechanisms result in a rigid connection between tiles, which prevent the tiles from flexing, at least to some degree. Further, such tiles may also require a prepared surface that is generally even. If the surface has too much variation, the locking mechanisms may not work as intended, or at all.

It may be desirable to provide an interlocking tile that allows for deformation or shifting in response to forces applied to the tile surface, e.g., from walking or driving on the surface. In some instances, it may be advantageous to permit vertical movement of the tiles and/or provide a variance in height during installation, particularly on uneven surfaces.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, an interlocking tile includes a top surface, a bottom surface, and marginal faces disposed along a perimeter of the top surface. The tile also includes at least one male coupler disposed on a first marginal face and at least one female coupler extending from the bottom surface and disposed on a second marginal face. The at least one female coupler includes an arm, which has a first notch for engaging with a corresponding male coupler of an adjacent tile at a first position, and a second notch for engaging with the corresponding male coupler of the adjacent tile at a second position.

According to another embodiment, an interlocking tile system includes a first tile comprising a top surface, marginal faces disposed along at least a portion of a perimeter of the top surface, a male coupler disposed on a first marginal face, and a female coupler disposed on a second marginal face. The female coupler includes an arm, the arm comprising a first notch for engaging with a corresponding male coupler of an adjacent tile at a first position, and a second notch for engaging with the corresponding male coupler of the adjacent tile at a second position.

In still another embodiment, a method of adjoining interlocking floor tiles on an uneven surface comprises providing a plurality of floor tiles. Each tile has a male coupler extending from a first marginal face of the floor tile that includes an aperture. Each tile further includes a female coupler disposed along a second marginal face of the floor tile. The female coupler includes an arm having a proximal and a distal end and a plurality of notches located generally near the distal end. The method further includes positioning a first tile of the plurality of tiles generally adjacent a second tile of the plurality of tiles such that the male coupler of the first tile is generally adjacent the female coupler of the second tile. The first and second tiles are interlocked by inserting the arm of the female coupler of the second tile into the aperture of the male coupler of the first tile such that one of the plurality of notches of the arm of the female coupler of the second tile engages with the male coupler of the first tile.

DETAILED DESCRIPTION

Figure 1:
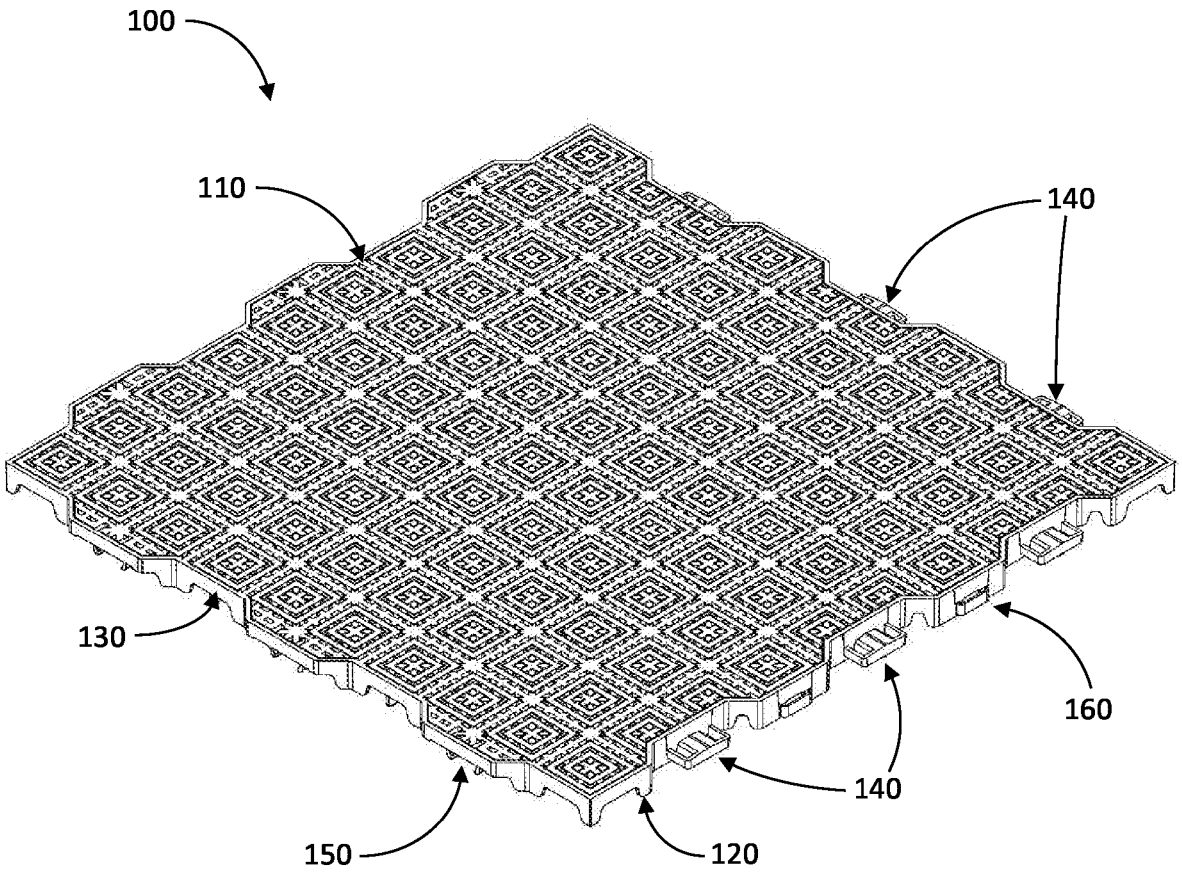
FIG. 1 is a top perspective view of a floor tile according to an embodiment of the invention.
Figure 2:
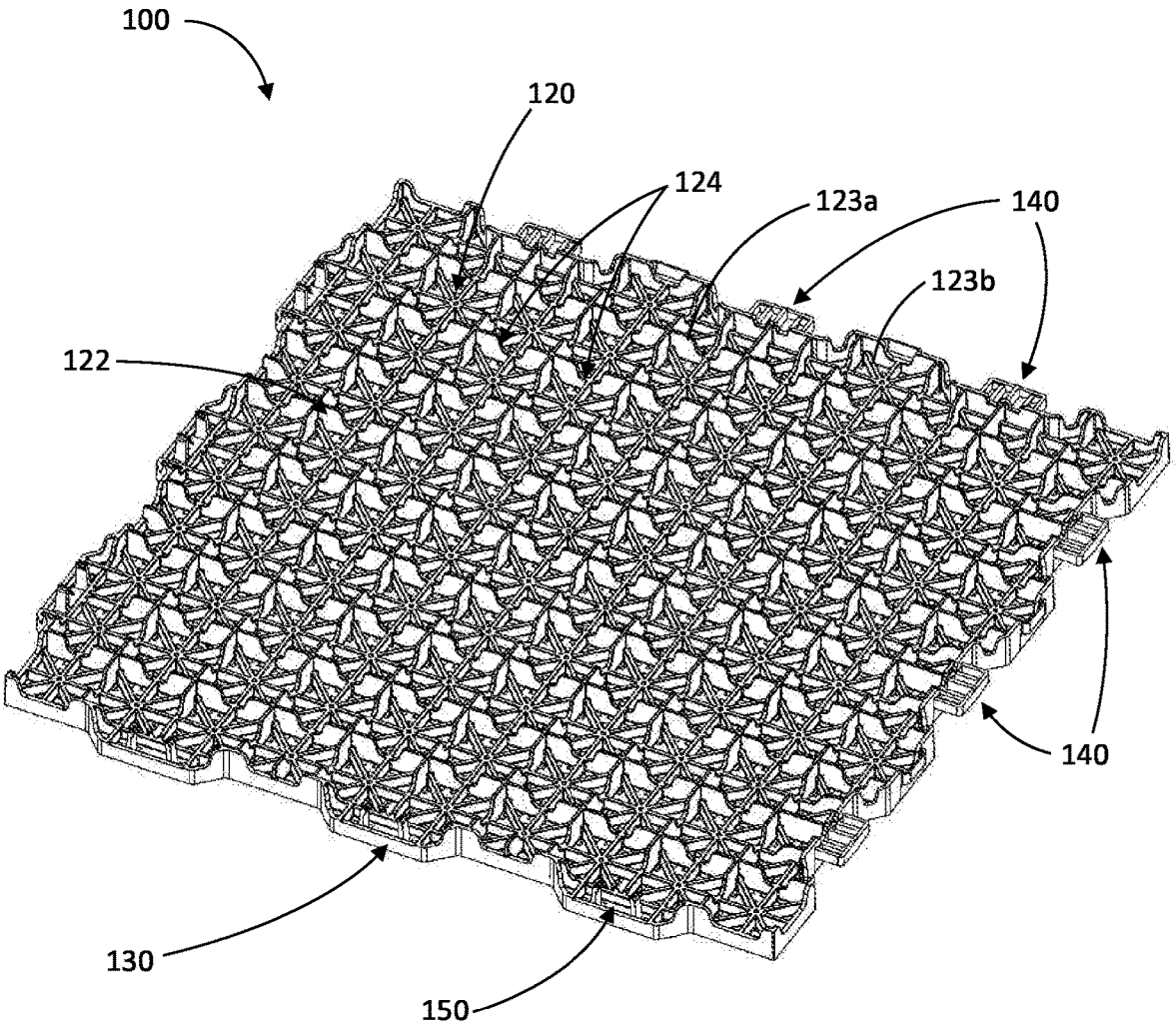
FIG. 2 is a bottom perspective view of the floor tile of FIG. 1.
Figure 4:
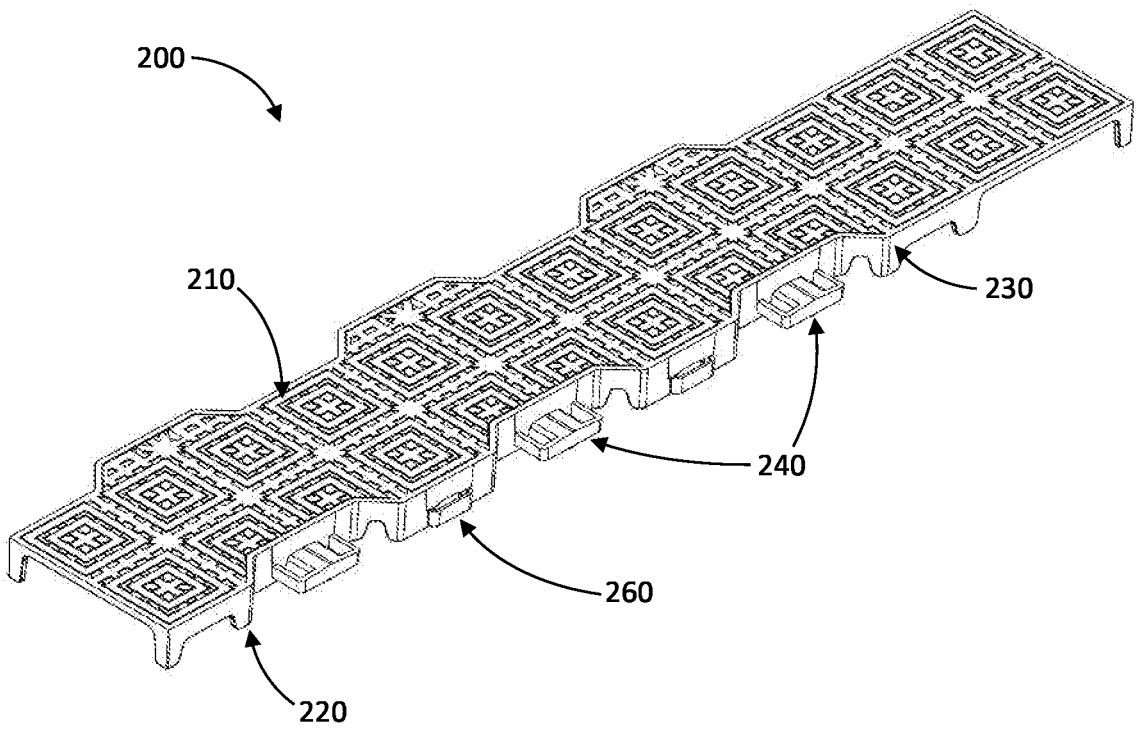
FIG. 4 is a top perspective view of a floor tile channel according to another embodiment of the invention.

FIGS. 1 and 2 show an embodiment of a floor tile 100 which has a top surface 110 (FIG. 1), an optional bottom surface 120 (FIG. 2), and marginal faces 130 which may extend at least partially along a perimeter of the top surface 110. Top surface 110 may be generally even and regular. In some embodiments, voids 111 may defined in the top surface 110, e.g., to allow for drainage, as shown in FIG. 4.

Bottom surface 120 includes a support structure 122, which supports the tile 100 above the surface. The support structure 122 may include portions 123*b* that extend from the bottom surface 120 provide strength to the tile top surface 110. Additionally, the support structure 122 may include portions 123*a* that extend beyond the portions 123*b*. The portions 123*a* contact the ground surface when the tile 100 is in an installed configuration.

Figure 5:
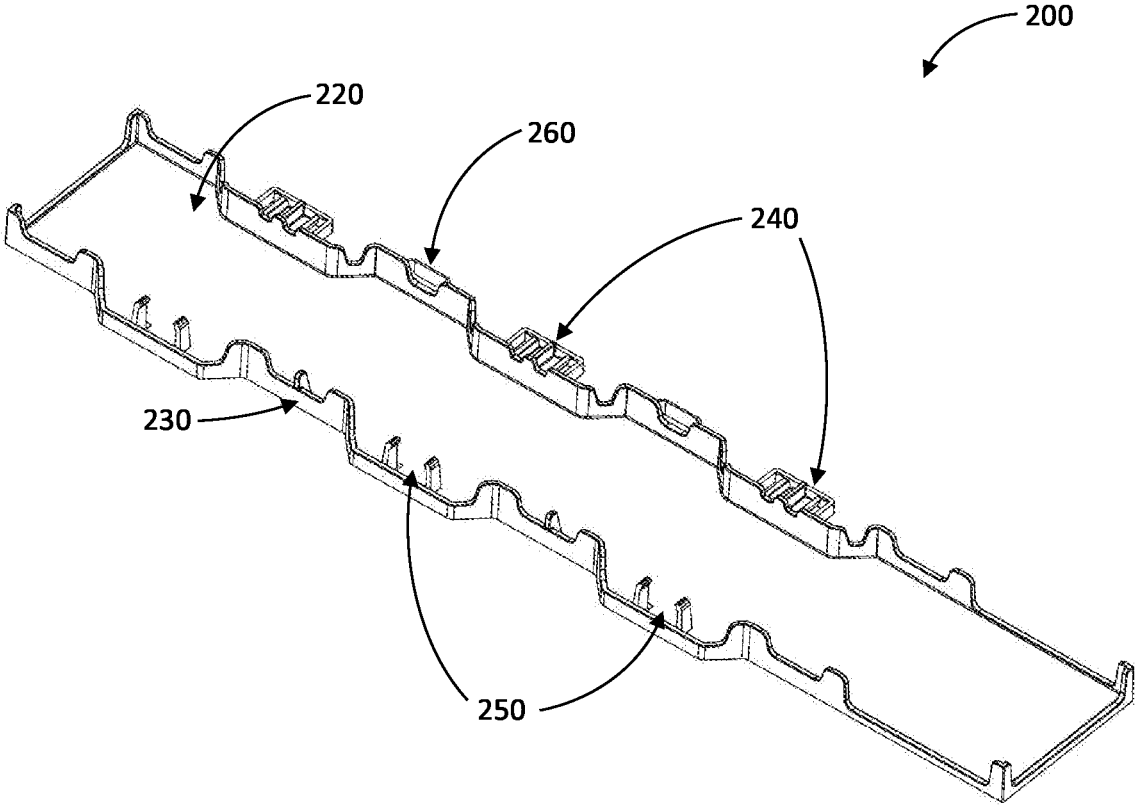
FIG. 5 is a bottom perspective view of the tile channel of FIG. 4.

Referring also to FIG. 5, in some embodiments, passages 124 may be defined within the support structure 122. The passages 124 may improve the drainage underneath the floor tile 100. Passages 124 may also facilitate additional aspects of the tile 100, for example, allowing for tubing or wiring to pass under the floor tile 100. The tubing or wiring may be contained within passages 124. In some embodiments, the passages 124 may span the entire width of bottom surface 120, in lieu of any support structure 122, e.g., as is the case with channel tiles 200, described in greater detail below As noted above, marginal faces 103 extend around the perimeter of the tile 100, and may be generally perpendicular to the top surface 110. In some embodiments the marginal face 130 may be offset from top surface 110 at a non-perpendicular angle. Marginal faces 130 extend past the bottom surface 120 of the floor tile 100 and may form a part of the support structure 122. In some embodiments, marginal face 130 may be of variable height, as shown in FIG. 5.

In the illustrated embodiment, tile 100 has a generally rectangular shape, although it will be understood by those of skill in the art that tile 100 may resemble a variety of shapes, such as generally triangular, trapezoidal, pentagonal, hexagonal, and octagonal.

Figure 3:
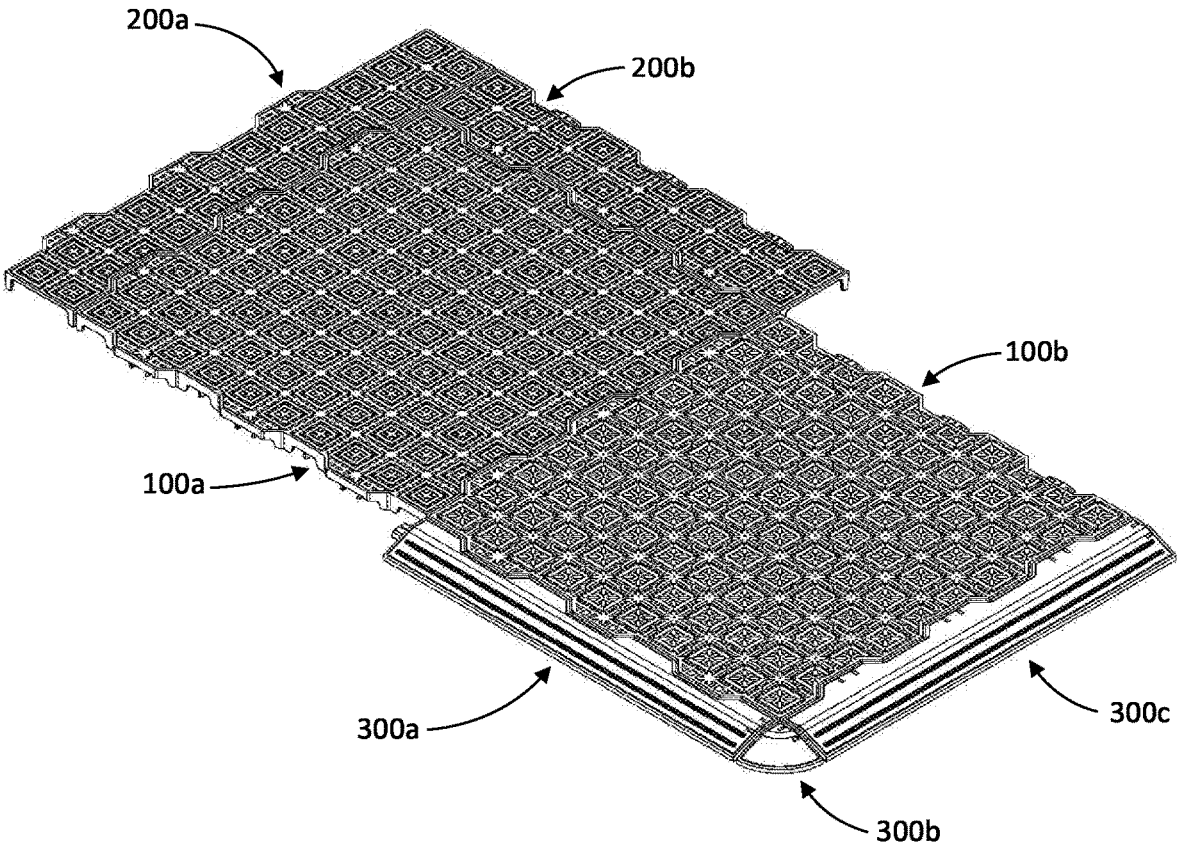
FIG. 3 is a top perspective view of a floor tile system according to an embodiment of the invention.

In some embodiments, the tile 100 is configured to couple to other tiles 100 and/or tile components. For example, FIG. 3 illustrates a tile system showing a first tile 100*a* coupled to a second tile 100*b* and tile channels 200*a* and 200*b*. A tile channel 200 is illustrated in FIGS. 4 and 5 and is substantially similar to floor tile 100, except as specifically noted and/or shown, or as would be inherent. For uniformity and brevity, reference numbers from 200 to 299 may be used to indicate elements corresponding to those discussed above numbered from 100 to 199 (e.g., top surface 210 corresponds generally to the top surface 110, faces 230 correspond generally to the respective faces 130, et cetera), though with any noted, shown, or inherent deviations.

As illustrated in FIG. 5, tile channel 200 may have a bottom surface 220 which is generally planar. Tile channel 200 may vary from tile 100 in that tile channel 200 may not include a supporting structure or any portion which extends outward from the bottom surface 220. This may be desired in order to create a larger passage underneath the tile channel 200 for wiring, piping, drainage, or any other system which may be installed below tile channel 200.

Figure 6:
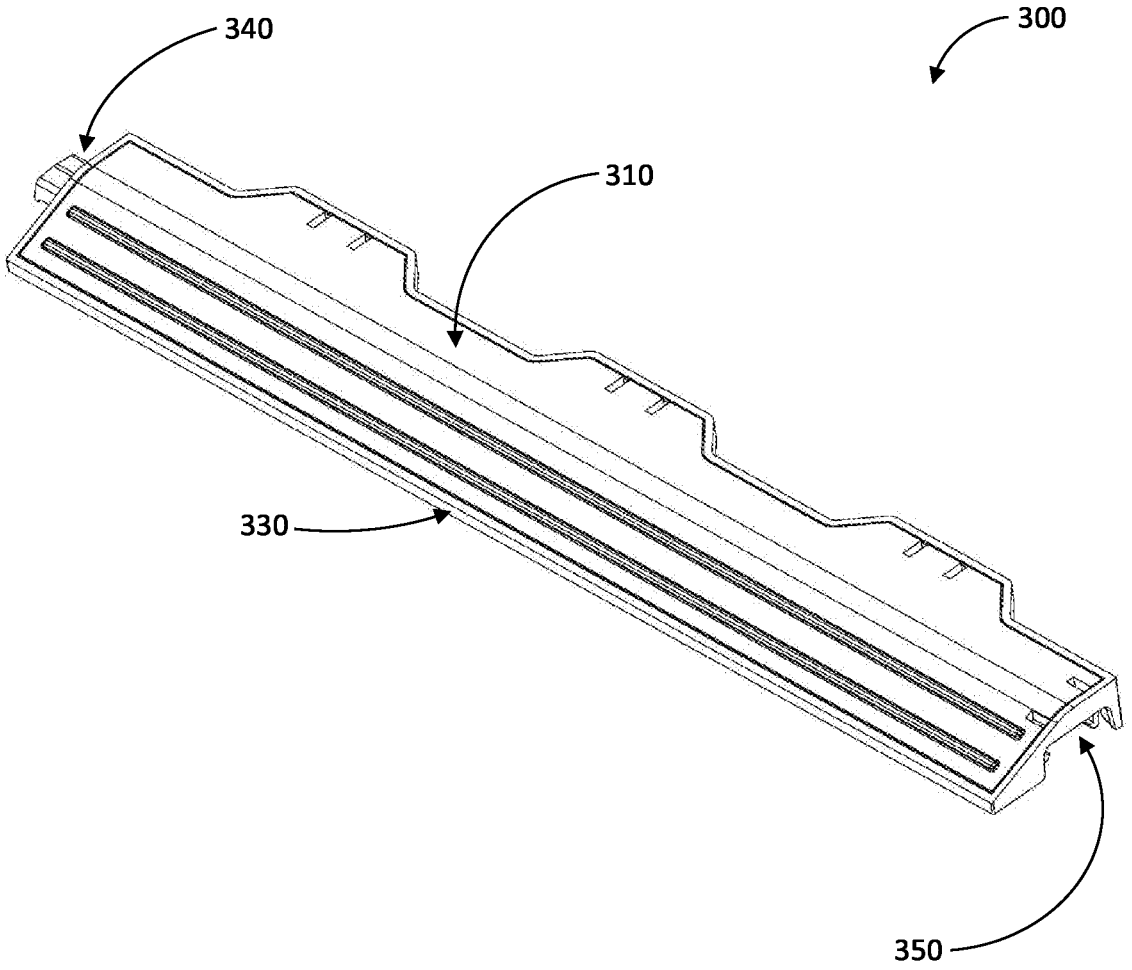
FIG. 6 is a top perspective view of a floor tile edge piece according to yet another embodiment of the invention.
Figure 7:
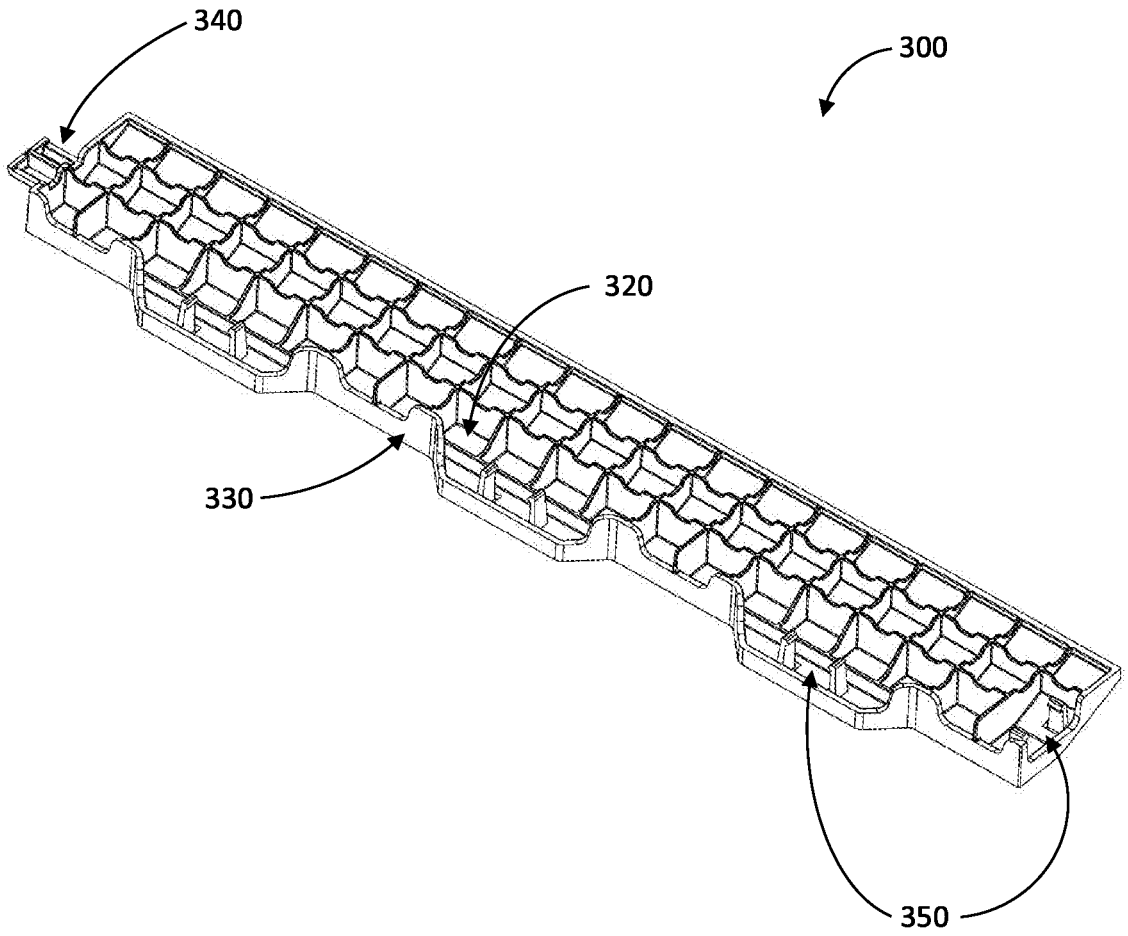
FIG. 7 is a bottom perspective view of the floor tile edge piece of FIG. 5.

The second tile 100*b* in FIG. 3 is coupled to edge pieces 300*a*, 300*b*, and 300*c*. Edge pieces 300 are illustrated in FIGS. 6 and 7. As shown in FIG. 6, edge piece 300 may include a top surface 310 which includes a generally planar portion and a portion 330 which is angularly offset from horizontal.

Figure 8:
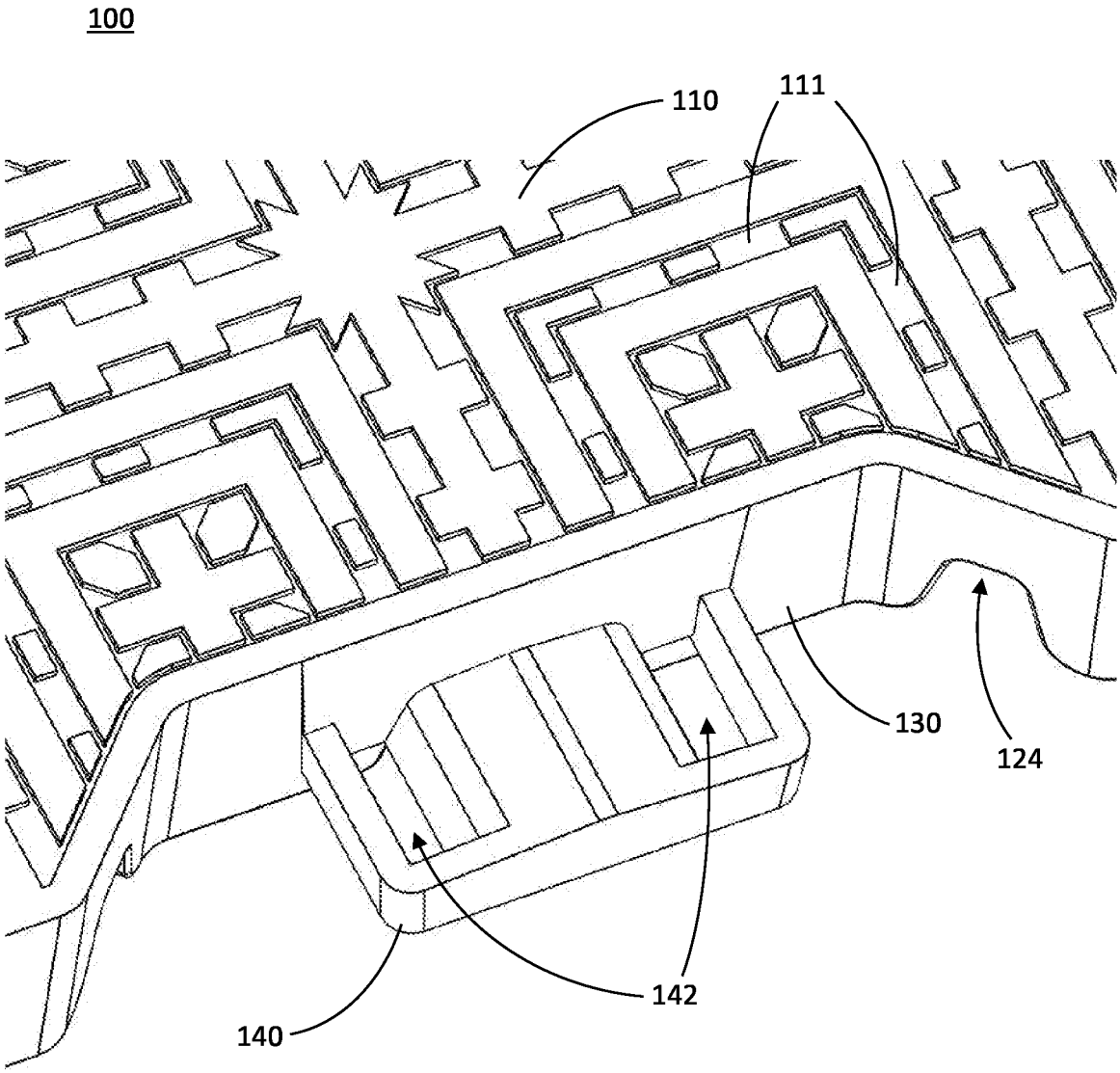
FIG. 8 is a magnified top perspective view of a portion of the floor tile of FIG. 1.
Figure 9:
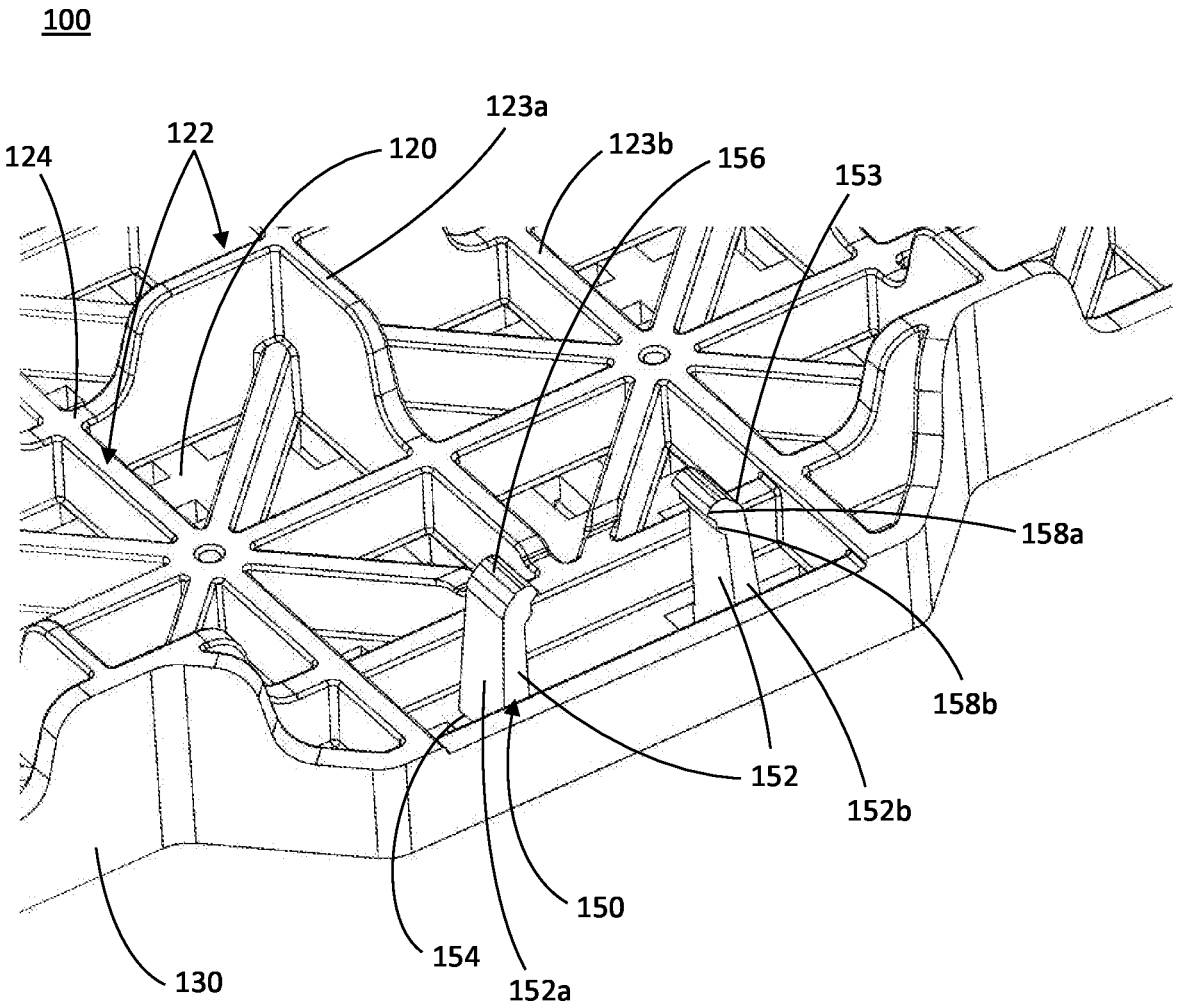
FIG. 9 is a magnified bottom perspective view of a portion of the floor tile of FIG. 1.
Figure 10:
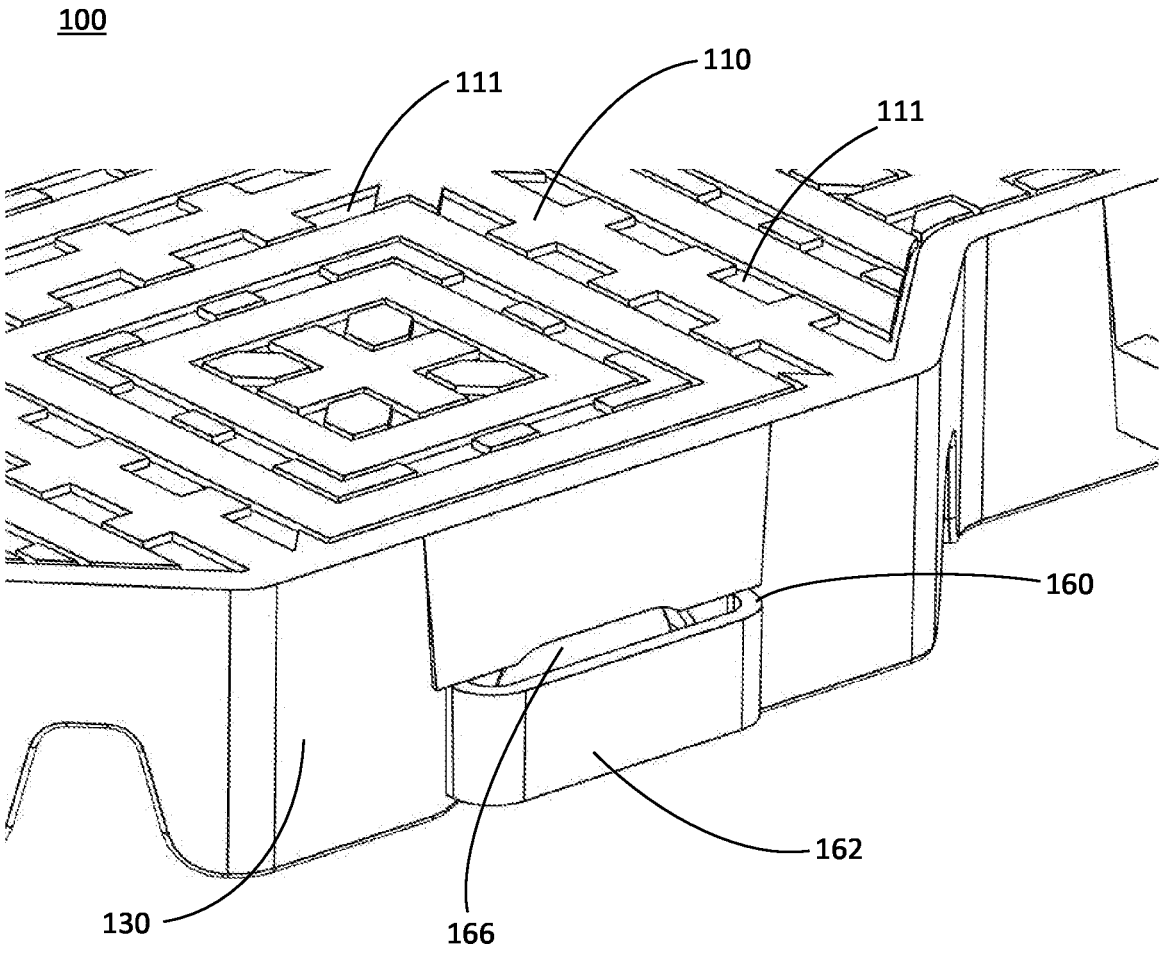
FIG. 10 is a magnified side perspective view of a portion of the floor tile of FIG. 1.

To facilitate coupling of floor tiles 100, tile channels 200 and/or edge pieces 300, floor tiles 100 and tile channels 200 may have at least one male coupler 140 (FIG. 8) and at least one female coupler 150 (FIG. 9). Preferably, floor tiles 100 and tile channels 200 may have a plurality of male couplers 140 and female couplers 150. Although not necessary, the male couplers 140 may be disposed along two adjacent sides 130 of a tile 100, with female couplers 150 being disposed along the remaining two adjacent sides 130. Alternatively, male couplers 140 may be disposed along two opposing sides 130 of a tile 100, with female couplers 150 being disposed along the remaining two opposing sides 130. Of course, where the tile 100 includes more or less than four sides, each side may have male couplers 150 or female couplers 140. The tile channels 200 may include one or more male couplers 240 disposed along a first long edge, with one or more female couplers 250 disposed along an opposing second long edge. Short edges of the tile channels 200 may or may not include couplers 240 and/or 250.

As shown in FIG. 6, each edge piece 300 may include at least one male coupler 340 or at least one female coupler 350 along a long edge (or along a straight edge, if it's a corner edge piece). Accordingly, edge pieces 300 may be particularly configured to attach to a side of a tile having either a male coupler 340 or a female coupler 350. In some embodiments, each short edge of the edge pieces 300 may additionally include a male coupler 340 or a female coupler 350, and preferably may include a male coupler 340 on one short edge and a female coupler 350 on the opposing short edge, to facilitate coupling of the edge piece along the perimeter of the tiles 100.

Referring now to FIG. 8, a male coupler 140 is illustrated with a tile 100. Male couplers 140 may extend outward from marginal face 130 of tile 100. Preferably, the male couplers 140 may extend perpendicularly from the marginal face 130, although it may be advantageous for the couplers 140 to extend at a non-perpendicular angle from the marginal face 130. In FIG. 4, the male couplers 140 do not extend the entire height of the marginal face 130. However, it will be understood by those of skill in the art that the male couplers 140 may extend along the entire height of the marginal face 130.

Each male coupler 140 may include a central portion and at least one aperture 142 for connecting with a corresponding female coupler 150. Preferably, each male coupler 140 has a plurality of apertures 142.

It shall be understood that a male coupler 240, 340 on a tile channel 200 or an edge piece 300, respectively, is substantially similar to the male coupler 140 described herein. For example, tile channels 200 (FIGS. 4 and 5) may have a male coupler 240 which is substantially similar to, and performs substantially the same function, as male coupler 140. Edge pieces 300 (FIGS. 6 and 7) may similarly have a male coupler 340 which performs substantially the same function as male couplers 140, but includes only the central portion of the male coupler and does not include any apertures.

Referring to FIG. 9, a female coupler 150 is illustrated with a tile 100. It shall be understood that a female coupler 150 on a tile channel 200 or an edge piece 300 is substantially similar to that described herein. The female couplers 150 are configured to be complimentary to the male couplers 140, such that floor tiles 100 may be coupled together to form a tile system. Female couplers 150 may include at least one arm 152 extending from bottom surface 120 of the floor tile 100, and preferably two opposing arms 152*a* and 152*b*. Each arm 152 has a proximal end 154, a distal end 156, and at least one notch 158 on an inside face of an elbow 153 of the arm 152.

As shown in FIG. 9, the arms 152 may have two notches 158*a* and 158*b*. The notices 158*a* and 158*b* may not be colinear. In other words, the first notch 158*a* may be generally inwardly offset as compared to the second notch 152*b*. Unlike a single notch, the double notch may allow for floor tiles 100 to be installed over an uneven surface so that if a tile 100 is slightly elevated compared to an adjacent tile 100, the first notch 158*a* may engage with a corresponding male coupler 140 of the adjacent tile 100. If the neighboring tiles 100 are on the same level, the second notch 158*b* may engage with the corresponding male coupler 140 of the adjacent tile 100. Thus, it shall be understood that adjacent tiles 100 may be adjoined on different horizontal planes depending on which notch 158*a* or 158*b* is engaged between respective male and female couplers 140 and 150. Although in the illustrated embodiments, the arms 152 have two notches, it will be understood by those of skill in the art that arms 152 may have any number of notches 158, and may therefore be able to engage with male coupler 140 at a plurality of heights.

The arms 152 may be positioned inside of the marginal face 130. Additionally, as shown in FIG. 1, the top surface 110 may extend over the female coupler 150. This may allow the respective marginal faces 130 of adjacent tiles 100 to more closely abut.

Figure 11:
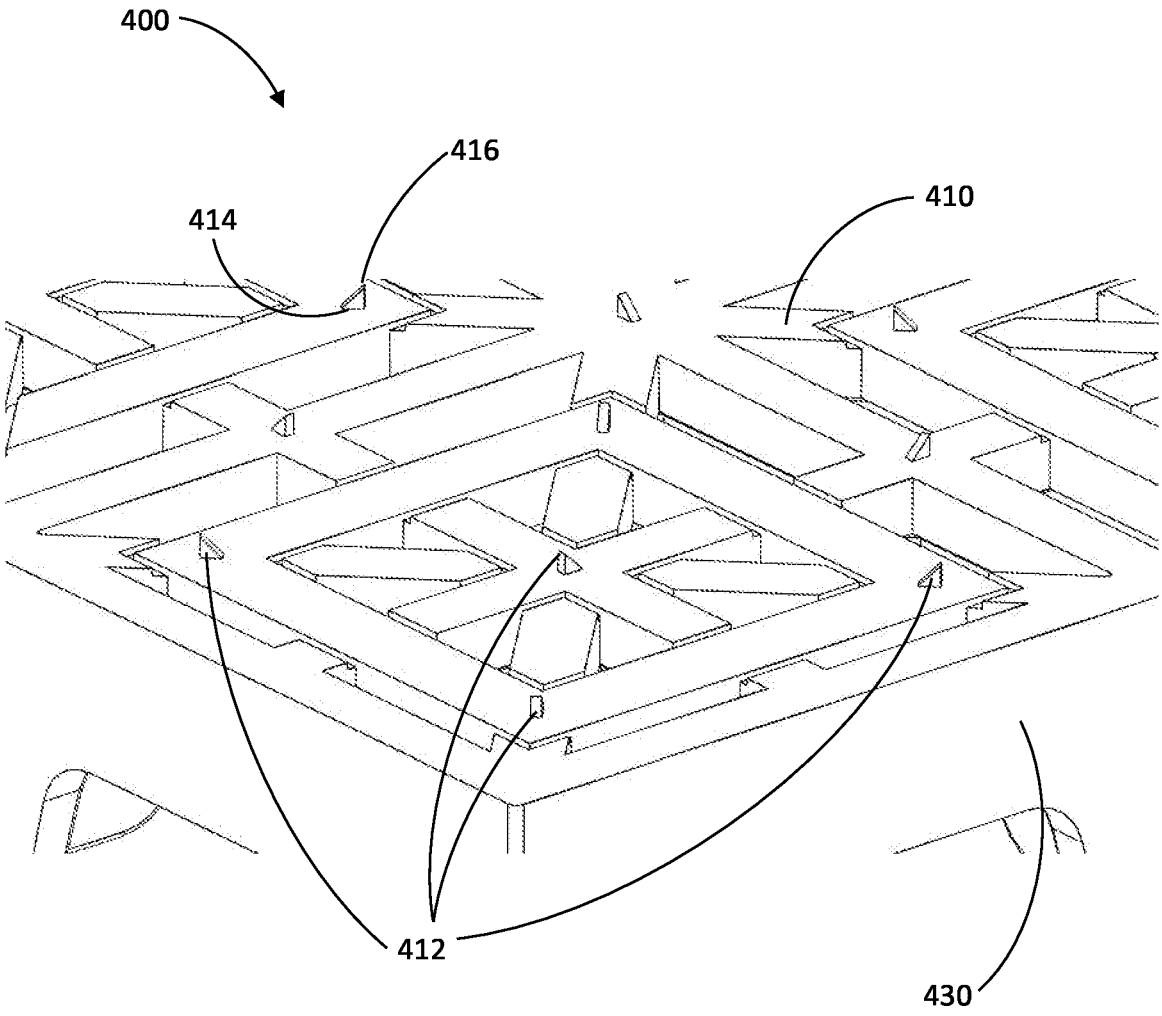
FIG. 11 is a top perspective view of a floor tile according to another embodiment of the invention.

Moving on, FIG. 11 illustrates a spring tab 160 disposed along the marginal face 130 of a floor tile 100. The spring tab 160 may have an exterior face 162 and a slot 166. Preferably, floor tile 100 has a plurality of spring tabs 160 disposed along the marginal face 130. Spring tabs 160 create a gap between adjacent tiles 100. The creation of a gap between tiles 100 may allow for a small amount of deformation during impacts. Furthermore, the gap created by spring tabs 160 may allow for expansion or contraction of the floor tiles 100 when subject to extreme temperatures, thereby minimizing the likelihood of component failure.

In the illustrated embodiment, the exterior face 162 of spring tab 160 is generally planar and is substantially parallel to the marginal face 130. However, in some embodiments, the exterior face 160 may not be generally planar, and instead may be concave, convex, or angled.

The spring tabs 160 may be constructed from the same material as the other components of floor tile 100. However, it may be beneficial to construct the spring tabs 160 from a different material than that of the rest of floor tile 100. For example, a more flexible material, in conjunction with various shapes of the spring tabs 160, may provide a more desirable level of impact dispersion and/or temporary deformation.

It shall be understood that tile channels 200 may optionally additionally include spring tabs 160.

FIG. 11 illustrates another embodiment of a floor tile 400 that is substantially similar to floor tile 100, except as specifically noted and/or shown, or as would be inherent. Further, those skilled in the art will appreciate that the embodiment 100 (and thus the embodiment 400) may be modified in various ways, such as through incorporating all or part of any of the described embodiments, for example. For uniformity and brevity, reference numbers from 400 to 499 may be used to indicate elements corresponding to those discussed above numbered from 100 to 199 (e.g., top surface 410 corresponds generally to the top surface 110, faces 430 correspond generally to the respective faces 130, et cetera), though with any noted, shown, or inherent deviations.

Tile 400 may have at least one projection 412 having a proximal end 414 and a distal end 416 and extending from the top surface 410. Preferably, tile 400 may have a plurality of projections 412 extending from the top surface 410. Projections 412 may provide increased resistance against shifting of artificial turf or any other material which may be placed upon the top surface 410. Even without a material atop the tile 400, the projections 412 may friction to the top surface 410 to prevent slippage, e.g., of a person moving atop the tile 400 or a vehicle driving atop the tile 400.

In the illustrated embodiment, projections 412 have a general triangular prism shape. However, it will be understood by those of skill in the art that projections 412 may be any shape, including rectangular, conical, cylindrical, pyramid, et cetera.

It may be advantageous for the at least one projection 412 to form part of a coupling mechanism with any surface material that may be applied to the tile 100. For example, a corresponding recess may be provided in the turf backing or other surface material. In this configuration, the risk of uncontrolled movement of the applied turf may be significantly minimized. However, even with corresponding recesses, the projections 412 may greatly reduce unwanted shifting of the material atop the tile 400. Further, the projections 412 may reduce or even eliminate the need for adhesives to be applied between the tile 400 and any surface material, which may reduce the time required for installing a tile and surface material systema and further allow for easier maintenance of the system.

The projections 412 may be molded (e.g., via injection molding, co-injection molding, overmolding, multi-material injection molding, etc.) as part of the floor tile 400. The projections 412 may be molded via a removable insert which may be added or removed to the tile mold during the molding process. This may be beneficial, as it allows for a variation in design or functionality of the tiles without the need for bespoke molds.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An interlocking tile, comprising:

a top surface;

a bottom surface;

marginal faces disposed along a perimeter of the top surface;

at least one male coupler disposed on a first marginal face; and at least one female coupler extending from the bottom surface and disposed on a second marginal face, the at least one female coupler comprising at least one arm, each arm comprising a first notch for engaging with a corresponding male coupler of an adjacent tile at a first position, and a second notch for engaging with the corresponding male coupler of the adjacent tile at a second position.

2. The tile of claim 1, wherein the top surface comprises at least one projection extending upwardly therefrom.

3. The tile of claim 2, wherein the shape of the at least one projection is selected from the group consisting of: triangular prism, rectangular prism, cylindrical, conical, and pyramidal.

4. The tile of claim 1, wherein the at least one male coupler comprises a plurality of male couplers.

5. The tile of claim 4, wherein the plurality of male couplers is disposed on a first pair of adjacent marginal faces.

6. The tile of claim 5, wherein the at least one female coupler comprises a plurality of female couplers.

7. The tile of claim 6, wherein the plurality of female couplers is disposed on a second pair of adjacent marginal faces.

8. The tile of claim 4, wherein the at least one female coupler comprises a plurality of female couplers.

9. The tile of claim 1, wherein the male coupler comprises an aperture extending therethrough, the arm of the female coupler being received into the aperture of the male coupler such that the first notch or the second notch of the female coupler engages with the male coupler.

10. The tile of claim 1, wherein the at least one arm of the at least one female coupler is two opposing arms.

11. The tile of claim 10, wherein the male coupler comprises a middle portion and two opposing apertures, wherein respective opposing arms of the at least one female coupler are received into respective opposing apertures of the male coupler such that the first notch or the second notch of each respective arm engages with the middle portion of the male coupler.

12. The tile of claim 1, wherein the first position is in a different horizontal plane from the second position.

13. An interlocking tile system, comprising:

a first tile, comprising:

a top surface;

marginal faces disposed along at least a portion of a perimeter of the top surface;

a male coupler disposed on a first marginal face; and a female coupler disposed on a second marginal face and comprising at least one arm, each arm comprising a first notch for engaging with a corresponding male coupler of an adjacent tile at a first position, and a second notch for engaging with the corresponding male coupler of the adjacent tile at a second position.

14. The tile system of claim 13, wherein the first position and the second position are on different horizontal planes.

15. The tile system of claim 13, further comprising a plurality of projections extending upwardly from the top surface.

16. The tile system of claim 13, further comprising a second tile, the second tile comprising:

a top surface;

a bottom surface;

marginal faces disposed along at least a portion of a perimeter of the top surface;

a male coupler disposed on a first marginal face; and a female coupler disposed on a second marginal face and comprising at least one arm, each arm comprising a first notch for optionally engaging with a corresponding male coupler of the first tile at a first position, and a second notch for optionally engaging with the corresponding male coupler of the first tile at a second position;

wherein the female coupler of the second tile is engaged with the male coupler of the first tile at the first position or the second position.

17. The tile system of claim 16, further comprising a surface material applied to the top surface of the first and second tiles.

18. A method of adjoining interlocking floor tiles on an uneven surface, comprising:

providing a plurality of floor tiles, each tile comprising;

a male coupler extending from a first marginal face of the floor tile, the male coupler comprising an aperture extending therethrough;

a female coupler disposed along a second marginal face of the floor tile, the female coupler comprising an arm having a proximal and a distal end and a plurality of notches located generally near the distal end;

positioning a first tile of the plurality of tiles generally adjacent a second tile of the plurality of tiles such that the male coupler of the first tile is generally adjacent the female coupler of the second tile;

interlocking the first and second tiles by inserting the arm of the female coupler of the second tile into the aperture of the male coupler of the first tile such that one of the plurality of notches of the arm of the female coupler of the second tile engages with the male coupler of the first tile.

19. The method of claim 18, wherein the notches of the plurality of notches are in different horizontal planes.

20. The method of claim 19, further comprising:

positioning a third tile of the plurality of tiles generally adjacent one of the first and second tiles of the plurality of tiles such that the male or female coupler of the third tile is generally adjacent the respective male or female coupler of the first or second tile;

interlocking the third tile to the one of the first and second tiles, wherein the male or female coupler of the third tile engages with the respective corresponding male or female coupler of the first or second tile, wherein the third tile is on a different horizontal plane than the first and second tiles in the interlocked configuration.

* * * * *